US010328718B2

(12) United States Patent
Condello et al.

(10) Patent No.: US 10,328,718 B2
(45) Date of Patent: Jun. 25, 2019

(54) PRINTABLE MERCHANDISE HOLDER FOR PRINTING OF CONTOURED OBJECTS

(71) Applicant: Xerox Corporation, Norwalk, CT (US)

(72) Inventors: Anthony S. Condello, Webster, NY (US); Peter J. Knausdorf, Henrietta, NY (US); Jack T. LeStrange, Macedon, NY (US); Mandakini Kanungo, Penfield, NY (US); Xin Yang, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 15/477,225

(22) Filed: Apr. 3, 2017

(65) Prior Publication Data

US 2018/0281460 A1 Oct. 4, 2018

(51) Int. Cl.

| | |
|---|---|
| ***B41M 1/40*** | (2006.01) |
| ***B41M 5/00*** | (2006.01) |
| ***B41J 3/407*** | (2006.01) |

(52) U.S. Cl.

CPC ..... *B41J 3/4073* (2013.01); *B41M 1/40* (2013.01); *B41M 5/0088* (2013.01)

(58) Field of Classification Search

CPC ..... B41J 3/4073; B41M 1/40

See application file for complete search history.

(56) References Cited

U.S. PATENT DOCUMENTS

| | | | |
|---|---|---|---|
| 9,156,281 B2 | 10/2015 | Dubuit et al. | |
| 9,272,815 B2 | 3/2016 | Uptergrove | |
| 9,302,506 B2 | 4/2016 | Uptergrove et al. | |
| 9,403,383 B1 | 8/2016 | Liu et al. | |
| 9,434,180 B2 | 9/2016 | Onodera et al. | |
| 9,463,649 B1 | 10/2016 | Liu et al. | |
| 9,511,607 B2 | 12/2016 | LeFevre | |
| 2010/0013880 A1 | 1/2010 | Polk et al. | |
| 2010/0186610 A1 | 7/2010 | Polk et al. | |
| 2010/0315459 A1 | 12/2010 | Chang et al. | |
| 2012/0147074 A1* | 6/2012 | Ikeda | B41J 3/28 347/8 |
| 2013/0342592 A1 | 12/2013 | Merz | |
| 2014/0029030 A1 | 1/2014 | Miller | |
| 2015/0298394 A1 | 10/2015 | Sheinman | |

FOREIGN PATENT DOCUMENTS

JP 2013-63554 A 4/2013

* cited by examiner

*Primary Examiner* — Julian D Huffman

(74) *Attorney, Agent, or Firm* — Fox Rothschild LLP

(57) ABSTRACT

A system for printing on a multi-dimensional object includes a plurality of print heads, and a printing chase configured to receive an object holder for an object and provide accurate registration of the object. The system further includes an actuator configured to move the printing chase relative to the print heads. The system is configured to receive information corresponding to an object holder mounted on the printing chase, determine a position of at least one printable area using the retrieved information, receive information relating to print data to be printed on the at least one printable area, use the determined position of the at least one printable area to control a movement of the printing chase relative to the print heads, and operate the print heads to eject marking material onto the at least one printable area to print data on the at least one printable area.

20 Claims, 10 Drawing Sheets

PRINTABLE MERCHANDISE HOLDER FOR PRINTING OF CONTOURED OBJECTS

BACKGROUND

Distinguishing consumer products, such as beverages, sports memorabilia, fashion accessories etc., from those of competitors in an attractive and interesting manner increases sales and consumption of the product. The visual appeal of a product may be optimized to appeal to a target market by adding designs on the product or the product container that appeal to the consumers. Furthermore, vendors or service providers often like to personalize their products to advertise the services offered to make the item more fun and entertaining, commemorate a special occasion, or the like. However, while printing on objects during the mass-manufacturing process itself is widely known (e.g., ball skins are printed with patterns or logos prior to the ball being completed and inflated during manufacturing), techniques for individualized printing on objects having curved, non-planar, or non-linear surfaces are generally limited and also very expensive.

For example, current systems for printing on an object having curved, non-planar, or non-linear surfaces require an object holder to hold the object steady while its position and/or orientation is carefully varied with respect to a print head by moving the object holder and/or the print head. Such object holders must be custom designed and made for each object (or for each batch of similar objects) to be printed, requiring additional resources and time which significantly adds to the cost of printing. Moreover, custom designed object holders also take up significant storage space.

These same objects often require some form of packaging for effective transportation, storage and/or disposal purposes. Such packaging must be discarded and/or temporarily removed for printing on the object further adding to cost and effort for printing directly on the object. Furthermore, typically separate printing system and/or steps are required for printing on the packaging material itself both before or after packaging the object, which further adds to the cost and complexity.

This document describes devices and methods that are intended to address issues discussed above and/or other issues.

SUMMARY

In some embodiments, system for printing on a multi-dimensional object may include a plurality of print heads, and a printing chase configured to receive an object holder for an object and provide accurate registration of the object relative to the plurality of print heads. The system may also include an actuator configured to move the printing chase relative to the plurality of print heads, a processing device, a non-transitory, computer-readable memory containing programming instructions. The system may be configured to receive information corresponding to an object holder when the object holder is mounted on the printing chase, and use the retrieved information to determine a position of at least one printable area on an object held within the object holder. In certain embodiments, the system may receive information relating to print data to be printed on the at least one printable area, use the determined position of the at least one printable area to control a movement of the printing chase relative to the plurality of print heads (via the actuator), and operate the plurality of print heads to eject marking material onto the at least one printable area such that the print data is printed on the at least one printable area.

In some embodiments, the printing chase may include a plurality of alignment elements, wherein one or more of the plurality of alignment elements are associated with the object holder. The information received corresponding to the object holder may include information corresponding to at least one alignment element included in the printing chase and employed for mounting the object holder on the printing chase. In an embodiment, the information corresponding to the at least one alignment element included in the printing chase includes one or more of the following: position of the at least one alignment element or identity of the at least one alignment elements.

Alternatively and/or additionally, the system may receive information corresponding to the object holder by receiving identifying information corresponding to the object holder from an identification tag included in the object holder, and using the identifying information to determine information corresponding to the object holder. In an embodiment, the information relating to the object holder may include one or more of the following: a type of the object held within the object holder, a number of objects held within the object holder, information regarding one or more characteristics of the object held within the object holder, information regarding a printable area of the object held within the object holder, information regarding one or more characteristics of the object holder, information regarding a printable area of the object holder, or a location of the object within the object holder.

In an embodiment, the at least one printable area is included in the object holder and/or an object mounted on the object holder.

In certain embodiments, the printing chase may include a base structure, and at least one alignment element configured to provide accurate registration of the object holder relative to the plurality of print heads. The alignment element may include an engagement structure configured to engage a complementary registration structure and/or a mating element associated with an object holder. In an embodiment, the size of the engagement structure may be configured to provide accurate registration of the object holder relative to the plurality of print heads in a direction perpendicular to a plane of the print heads. The engagement structure may be associated with the object holder. In some embodiments, the printing chase may further include a locking element configured to securely hold the object holder on the printing chase.

In some embodiments, the object holder may include at least one mating element configured to mount the object holder on the printing chase, and at least one holding portion configured to hold a three-dimensional object. The object holder may also include an identification tag that may comprise identification information relating to the object holder.

In another aspect, in a embodiment, a method for printing on a multi-dimensional object may include by a processor, controlling a movement of a printing chase relative to a plurality of print heads, wherein a multi-dimensional object is held within an object holder mounted on the printing chase. The movement of the printing chase may be controlled by receiving information corresponding to an object holder mounted on the printing chase, determining, using the retrieved information, a position of at least one printable area, receiving information relating to print data to be printed on the at least one printable area, using the determined position of the at least one printable area to control the movement of the printing chase relative to the plurality of print heads, via an actuator, and operating the plurality of print heads to eject marking material onto on to the at least one printable area such that the print data is printed on the at least one printable area.

DETAILED DESCRIPTION

Figure 1:
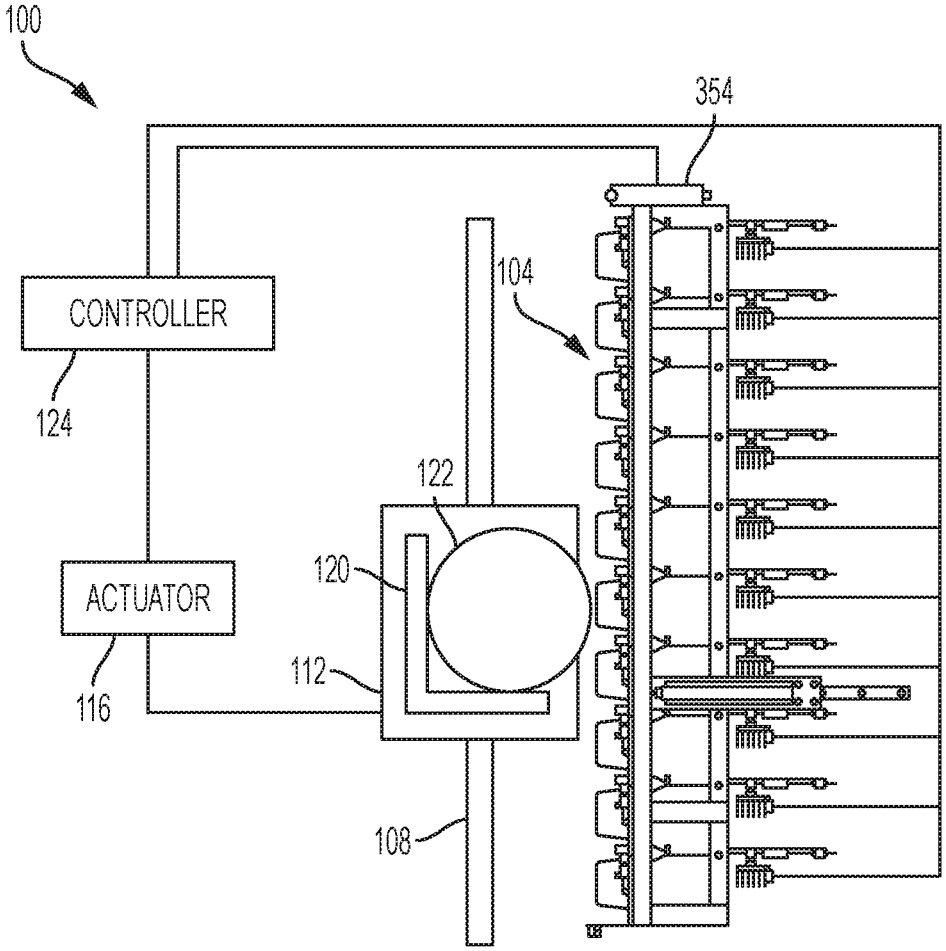
FIG. 1 illustrates an example of a print system for printing on a 3-dimensional object, according to an embodiment.

This disclosure is not limited to the particular systems, methodologies or protocols described, as these may vary. The terminology used in this description is for the purpose of describing the particular versions or embodiments only, and is not intended to limit the scope.

As used in this document, any word in singular form, along with the singular forms "a," "an" and "the," include the plural reference unless the context clearly dictates otherwise. Unless defined otherwise, all technical and scientific terms used herein have the same meanings as commonly understood by one of ordinary skill in the art. All publications mentioned in this document are incorporated by reference. Nothing in this document is to be construed as an admission that the embodiments described in this document are not entitled to antedate such disclosure by virtue of prior invention. As used herein, the term "comprising" means "including, but not limited to."

The term "object" refers to a print media substrate that is made of any multi-dimensional material. An object may include planar, curved, non-planar, or non-linear surfaces. Content may be printed on the print media substrate using toner and/or ink. The object may, for example, include one or more areas comprising characters, and one or more other areas comprising images. Examples of objects which can be printed as described below include, without limitation, round, spherical, rectangular, square, oval, or curved objects such as sporting balls, various types of containers (such as mugs, bottles, etc.), textile materials (such as fabrics used in clothing, hats, footwear, or other apparel), pens, photoframes, ceramics, or the like.

A "print device" or "print engine" is a device that is configured to print content on an object based on digital data, or a multi-functional device in which one of the functions is printing content based on digital data. Example components of a print device include a print head, which may include components such as a print cartridge containing ink, toner or another print material so that the print head can print characters and/or images on the object.

A "print system" is a system of hardware components that include a print device and other components. For example, a printing system may include a marking engine (i.e., the print hardware or print engine) and a digital front end. A digital front end (DFE) is an integrated print workflow management system, including one or more processing devices, capable of receiving and processing print requests and controlling the operation of a print engine to fulfill the print request. The DFE and print engine may be part of a single device (such as a digital printing press), or separate parts of a system of networked devices.

A "processor" or "processing device" is a hardware component of an electronic device that is configured to execute programming instructions. The term "processor" may refer to either a single processor or to multiple processors that together implement various steps of a process. Unless the context specifically states that a single processor is required or that multiple processors are required, the term "processor" includes both the singular and plural embodiments.

The term "element", as used herein, may refer to a physical structure, and/or marks, impressions, etc. drawn or otherwise included in a physical structure.

This document describes an object holder that may be used to mount an object held within the object holder to a print system via a printing chase when causing a print system to print on the object. An object holder may serve the conventional purpose of effective transportation and/or storage in addition to being used as an object holder within a print system, without damaging the packaging itself. In this system, the printing chase helps in the alignment of object holder and provides accurate registration of the object(s). In this way, printing on an object in its original packaging may be performed without wasting time and resources for designing and manufacturing object holders for each type of object, regardless of the dimensions, shape, or other characteristics of the object, and without compromising on the registration.

FIG. 1 illustrates an example of a print system for printing on an object. In some embodiments, the print system 100 may include an array or other set of print heads 104, a support member 108, a moving sled 112 movably mounted to the support member 108, an actuator 116 operatively connected to the moving sled 112, an object holder 120 configured to mount to the moving sled 112, and a controller 124 in communication with the print heads 104 and the actuator 116. As shown in FIG. 1, the array of print heads 104 may be arranged in a two-dimensional array, (e.g., a 10×1 array), although other array configurations can be used. In some embodiments, the controller 124 is also operatively connected to an optical sensor 354.

In some embodiments, each print head may be fluidly connected to a supply of marking material (not shown) and is configured to eject marking material received from the supply. In some embodiments, one or more of the print heads may be connected to the same supply. Alternatively and/or additionally, each print head may be connected to its own supply such that each print head may eject a different marking material.

In various embodiments, the support member 108 may be positioned to be parallel to a plane formed by the array of print heads and, as shown in FIG. 1, is oriented so one end of the support member 108 is at a higher gravitational potential than the other end of the support member. This orientation enables the printing system 100 to have a smaller footprint than an alternative embodiment that horizontally orients the array of print heads. While the embodiment shown in FIG. 1 illustrates a single rail acting as a support member 108, it will be understood to those skilled in the art that a plurality of rails disposed parallel to each other are within the scope of this disclosure.

In some embodiments, a moving sled 112 is movably mounted to the support member 108 to enable the moving sled to slide along the support member. In some embodiments, the moving sled 112 may move bi-directionally along the support member. In other embodiments, the support member 108 may be configured to provide a return path to the lower end of the support member to form a track for the movably mounted member. In various embodiments, an actuator 116 may be operatively connected to the moving sled 112 and configured to move the moving sled 112 along the support member 108 such that the object holder 120 connected to the moving sled 112 may pass the array of print heads 104 in one dimension of the two-dimensional array of print heads. In the embodiment, the object holder 120 moves an object 122 along the length dimension of the array of print heads 104. In some embodiments, the gap presented between the objects carried by the object holder 120 and the print heads of the array of print heads 104 is in a range of about five to about six mm.

The controller 124 is configured with programmed instructions stored in a memory in communication with the controller so the controller can execute the programmed instructions to operate components in the printing system 100. In various embodiments, the controller 124 may be configured to provide instruction to the actuator 116 to move the object holder 120 past the array of print heads 104. The controller may also be configured to operate the array of print heads 104 to eject marking material onto objects held by the object holder 120 as the object holder passes the array of print heads 104.

Figure 2:
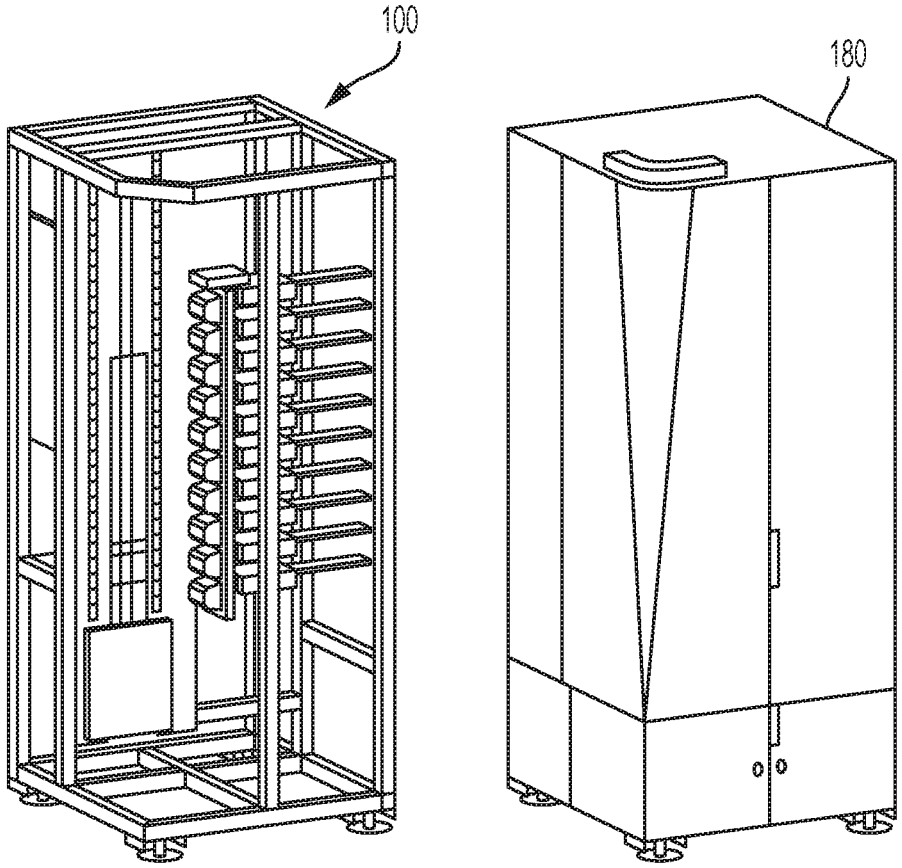
FIG. 2 illustrates an example cabinet within which the print system if FIG. 1 may be installed, according to an embodiment.

In various embodiments, the system configuration shown in FIG. 1 may be housed in a single cabinet 180, as depicted in FIG. 2, and installed in non-production outlets. Once installed, various object holders, as described further below, can be used with the system to print a variety of goods that are generic in appearance until printed.

Figure 3A:
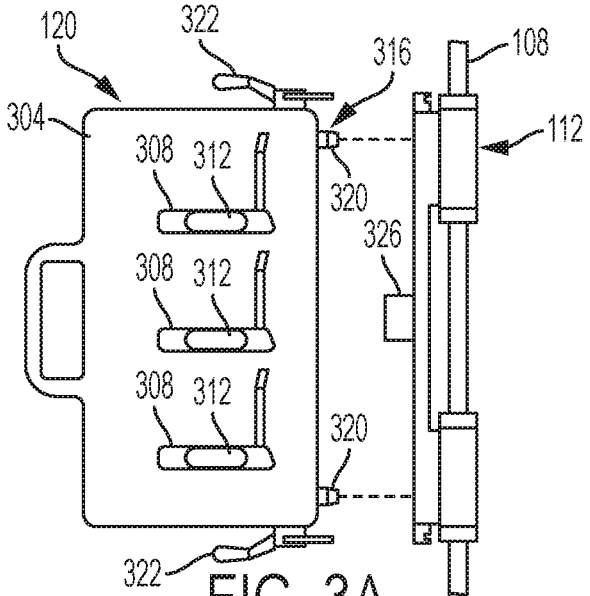
FIG. 3A PRIOR ART
FIGS. 3A and 3B illustrate a front view and a back view, respectively, of a prior art customized object holder for mounting an object in the print system of FIG. 1, according to an embodiment.
Figure 3B:
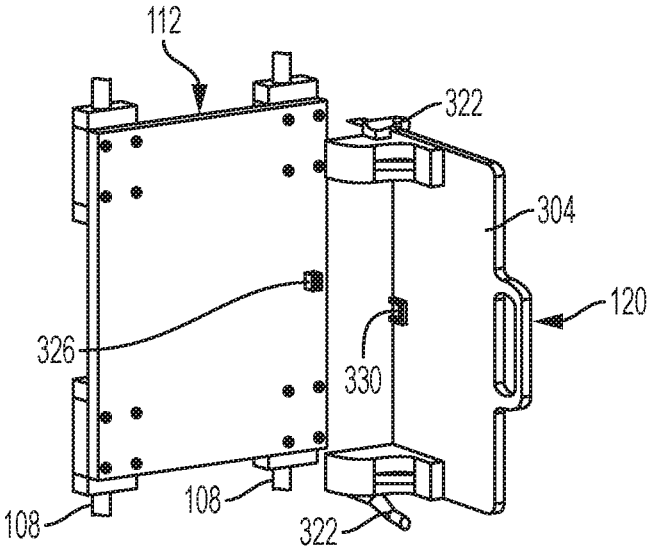
FIG. 3B PRIOR ART

An example of a prior art customized prior art object holder 120 is shown in FIG. 3A. As shown in FIG. 3A, the object holder 120 includes a plate 304 having apertures 308 in which objects 312, which are golf club heads in the figure, are placed for printing. A latch 316 is configured for selectively mounting the object holder 120 to the moving sled 112. The latch 316 includes locating elements 320 to aid in properly positioning the object holder 120 for securing the holder to the moving sled 112, which is supported by members 108 as shown in FIG. 3A. Once properly positioned, levers 322 operate the latch 316 to secure the holder 120 to the moving sled 112. FIG. 3B shows a front view of the object holder 120 secured to the moving sled 112. However, as discussed above, an object holder for a print system configured to print on 3D objects must be individually tooled or manufactured for each type of object, which leads to unnecessary consumption of resources, time, and money. This document describes an integrated object packaging system and object holder for use with the print system of FIG. 1 and FIG. 2.

Packaging for the most part has been designed with a single use intended, that being to get an item form one point to another with no damage occurring to the contents. Seldom is packaging designed to have more than one functional use to the end consumer.

Figure 4:
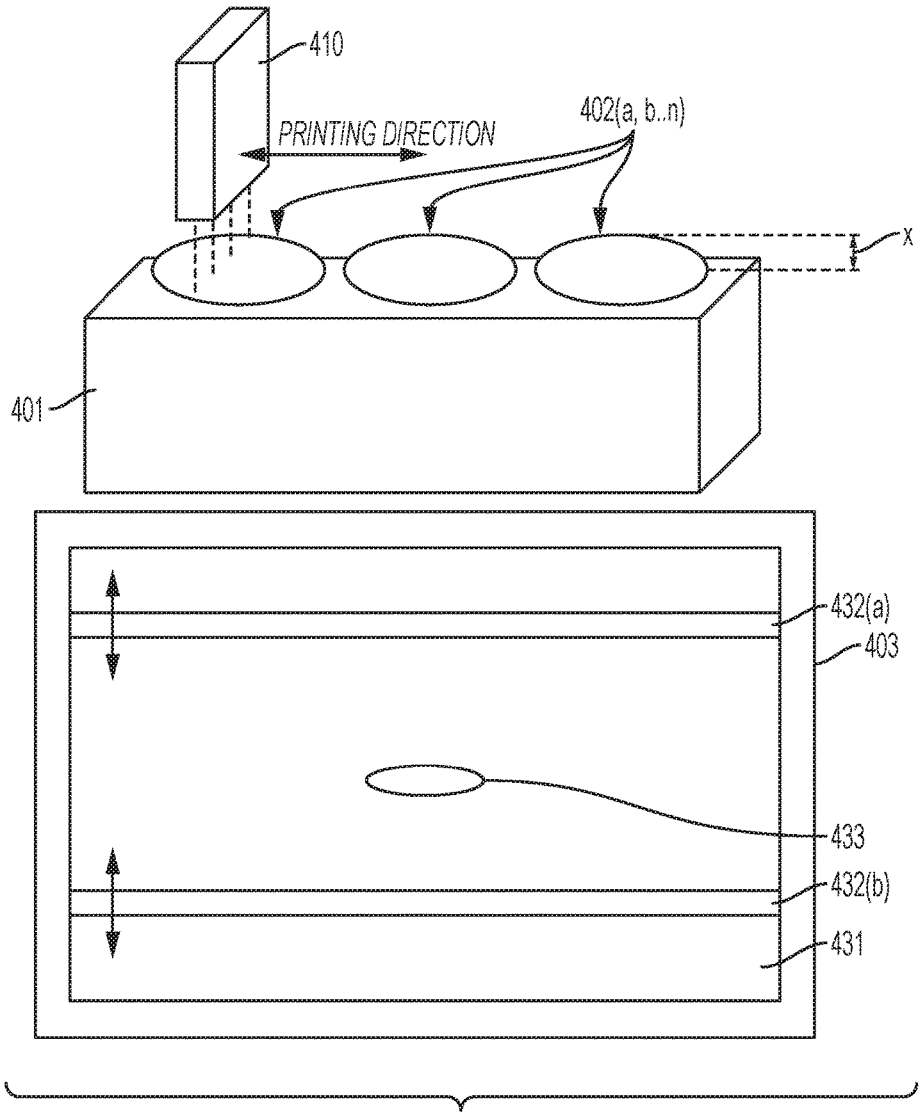
FIG. 4 illustrates a schematic view of an object holder configured to be mounted on a printing chase for mounting an object in the print system of FIG. 1, according to an embodiment.

Referring now to FIG. 4, the current disclosure describes an object holder 401 that may be used to mount one or more objects 402(*a*), 402(*b*) . . . 402(*n*) to a printing chase 403 configured to include universal mounting elements. In some embodiments, the printing chase 403 of FIG. 4 may be a modified moving sled of the print system described above and configured to be movably mounted on a support system (e.g., a pair of slider rails) of the print system of FIG. 1 described above. In an alternate embodiment, the printing chase 403 of FIG. 4 may be structure separate and distinct from a moving sled and configured to be securely mounted on the moving sled of the print system of FIG. 1 described above.

A printing chase is a structure configured for mounting an object holder to a support structure and/or a moving sled of a print system of FIG. 1. As shown in FIG. 4, a printing chase 403 may be configured to include universal locking elements and/or alignment elements for mounting an object holder. The printing chase 403 may include a base 431 configured for attachment with a support system and/or a moving sled of a print system, one or more locking elements 432, and one or more alignment elements 433. In various embodiments, an object holder (described below) 401 is mounted on the printing chase 403 using the locking elements and/or the alignment elements.

In various embodiments, the base 431 is generally square or rectangular shaped structure and may include various elements such as bores and apertures to facilitate securement of other device components thereto and/or for securing the base 431 to, for example, a support system and/or a moving sled of a print system. The size of the base 431 may be configured such that one or more objects included in an object holder may be mounted on the base 431.

In some embodiments, a locking element 432 may be configured to securely hold an object holder in a desired position on the printing chase 403. For example, as shown in FIG. 4, the locking element may include one or more sliding locking bars 432(*a*) and 432(*b*) that are configured to have an adjustable position depending upon the size, shape, orientation, etc. of the object holder and may apply a retaining force in a locked position to hold the object holder securely in place. For example, a locking element may be attached to a moving mechanism (such as sliding rails) to accurately position the locking element in its locked position based on the size, shape, orientation, etc. of the object holder. In another embodiment, a locking element may include one or more screws disposed in the printing chase configured to associate with and securely hold the object holder and/or another structure attached to the object holder (such as tabs, flanges, backer plates, or the like). Other examples of locking elements may include, without limitations, tensioning and securing devices, clamping devices, a spring-loaded locking mechanism, adhesive means, nut and bolts, threaded rods type locking mechanism, bar clamps, suction mechanisms, or the like, associated with the printing chase. While FIG. 4 illustrates two locking elements, it will be understood to those skilled in the art that any number of locking elements may be used to securely hold an object holder on a printing chase without deviating from the principles of the current disclosure.

In some embodiments, an alignment element 433 may be configured to accurately and reliably align an object holder 401 with respect to the printing chase 403. This allows a controller of a print system to accurately determine the position of one or more objects (and/or each printable area of each object) included in the object holder 401 as well as the object holder 401 itself (and/or each printable area of the object holder) with respect to the print heads 410 ("registration"). A skew, lateral misalignment or error in the registration of the object holder can lead to errors, such as image and/or color registration errors. One or more alignment elements of the current disclosure precisely and accurately locate, align, and/or orient an object holder relative to a reference location on the printing chase 403 in the x-, y-, and/or z-directions. The reference location may be a center of the printing chase and/or any other location on the printing chase. For example, an alignment element may include a pair of right angle lines associated with the printing chase 403 that may be used to align one or more corners of a rectangular object holder. In another example, an alignment element may include a center alignment element configured to align with a printable center of an object holder in association with a rotation alignment element configured to align at least one edge and/or at least one corner of the object holder. The alignment elements may include physical structures (such as raised structures, indentations, tabs, flanges, or the like) associated with the print chase and/or marks or other identification (such as, laser, color, IR, or other types of marks) drawn or otherwise included in the printing chase.

Figure 5A:
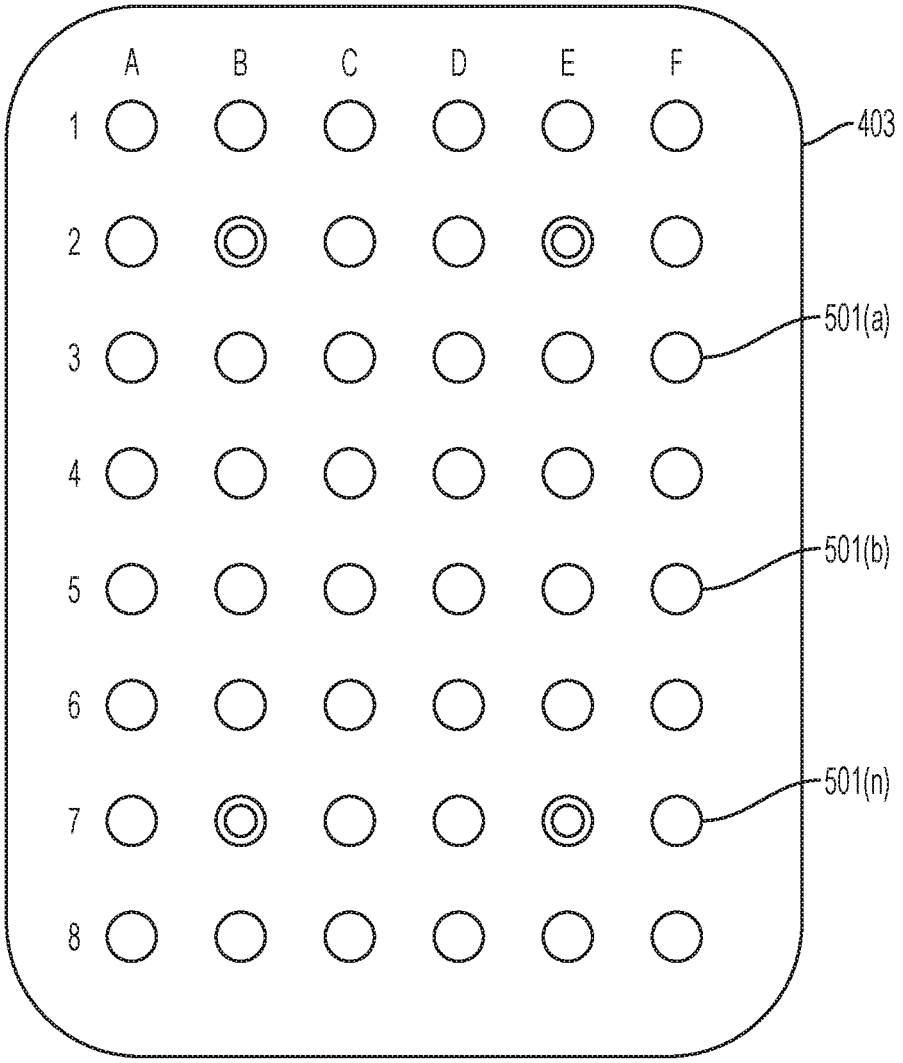
FIG. 5A illustrates a schematic front view of an example printing chase, according to an embodiment.

FIG. 5A illustrates an alternate example of a printing chase 403 that includes a plurality of identical alignment elements 501*a*, 501*b* . . . 501*n* (e.g., slots or holes) disposed in predetermined locations (e.g., as a grid or as an array), where each alignment element is configured to receive a complementary registration structure (e.g., a pin, screw, rod, or the like).

Figure 5B:
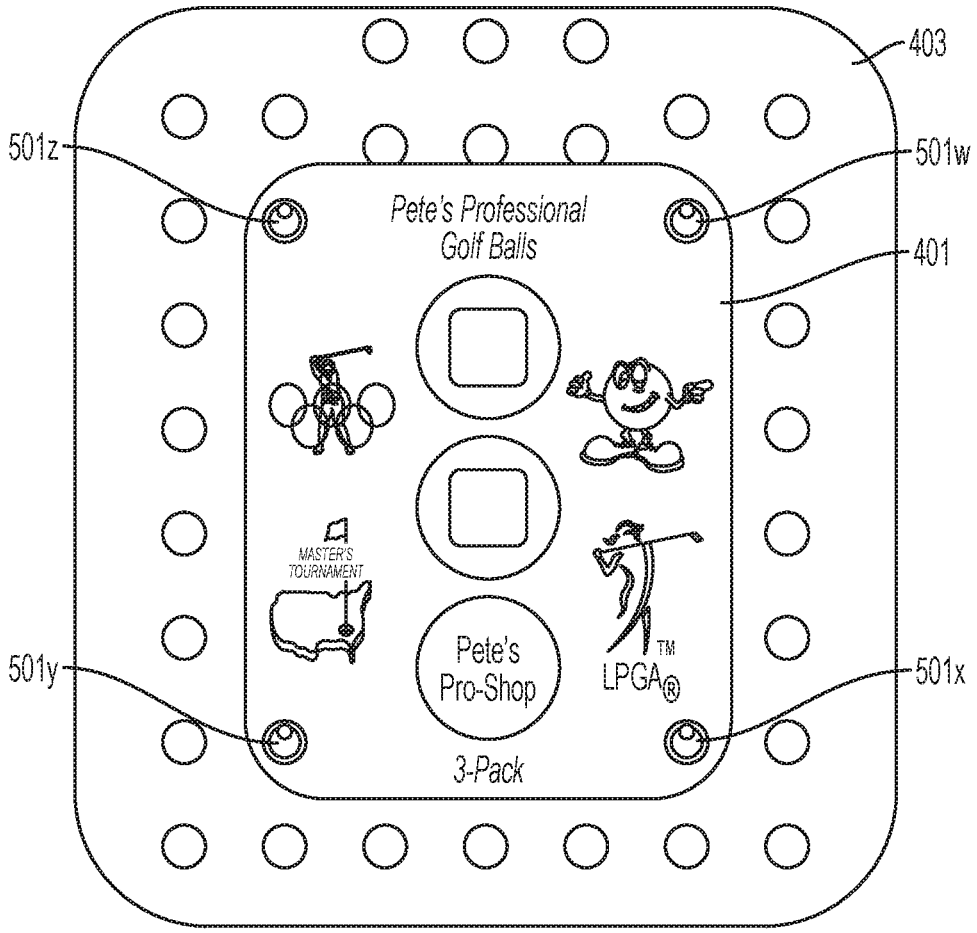
FIG. 5B illustrates a schematic front view of an example object holder mounted on the printing chase of FIG. 5A, according to an embodiment.

In various embodiments, one or more of the alignment elements may receive the complementary registration structure to align and locate the object holder, and the position and/or identity of the alignment elements employed may be used for registration of the object holder. In some embodiments, the position and/or identity of alignment elements employed for mounting and aligning an object holder may be determined using suitable sensors (e.g., electrical touch sensors, actuators, pressure sensors, electromagnetic sensors, radio frequency identification (RFID), etc.) and may be transmitted to a controller of a print system using suitable communication protocols (e.g., short range communication links, RFID tags, or the like). For example, as shown in FIG. 5A and FIG. 5B, alignment elements corresponding to the holes at positions B2, E2, B7, and E7 (501*w*, 501*x*, 501*y*, 501*z*) may be used to mount and align a rectangular object holder 401, and the identification information may be transmitted to a controller of a print system. In some embodiments, alignment elements (or sets of alignment elements) may be associated with a unique object holder, and engagement of the alignment elements may provide information about the object holder mounted on the printing chase. Examples of information regarding the object holder may include, without limitation, physical characteristics of the object holder (e.g., size, shape, material, etc.), number of objects held within the object holder, type of objects held within the object holder, information regarding the objects (such as shape, dimensions, material, etc.), information regarding the "printable area" of each object (such as shape, dimensions, material, etc.), location of each object (and/or printable area) within the object holder, or the like. For example, in the above embodiment, engagement of the holes at positions B2, E2, B7, and E7 for mounting and alignment of an object holder may provide information about the object holder, i.e., the object holder is rectangular in shape that includes three circular objects as well as information regarding the printable area on each object.

Other examples of an alignment element may include, without limitation, registration holes on the printing chase 403 and the object holder 401 that may be aligned for proper registration, registration pins, registration tabs, alignment of edges and/or corners maintained using sensors such as electrical contact sensors (without engaging), or the like.

In various embodiments, an alignment element may also include an engagement structure configured to engage and hold a complementary registration structure. For example, as shown in FIG. 4, a center alignment element 433 may include a slot or a hole configured to receive a complementary registration structure (e.g., a pin, screw, rod, or the like). In some embodiments, the registration structure may be associated with (e.g., integral part of) the object holder to be mounted and aligned on the printing chase.

Figure 6:
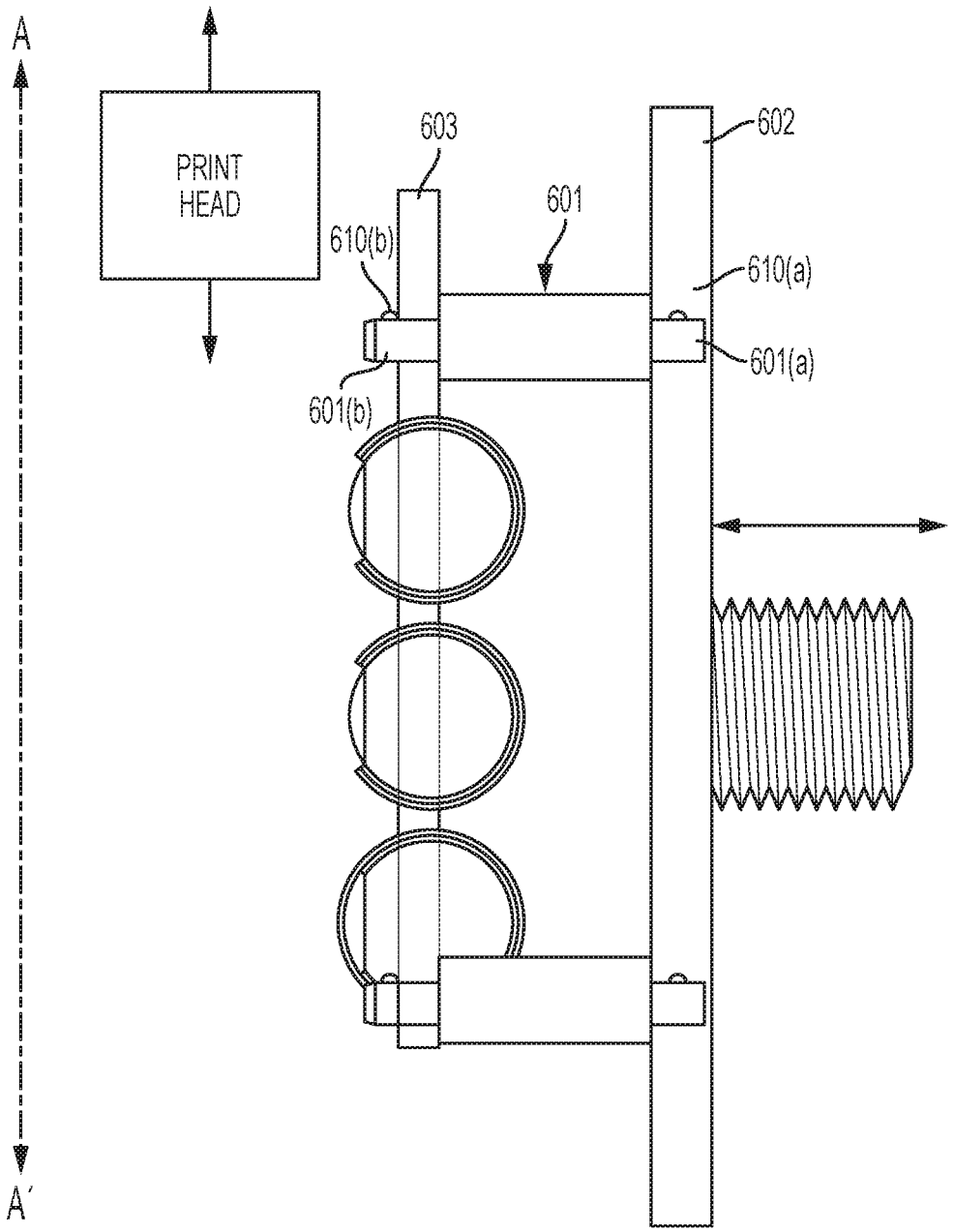
FIG. 6 illustrates a schematic side view of an object holder mounted on a printing chase using registration structures, according to an embodiment.

In an alternate embodiment, the registration structure may not be a part of the object holder but may be configured to engage the object holder in addition to the engagement structure of the alignment element. For example, FIG. 6 illustrates an example pin shaped registration structure 601 configured to associate with and/or engage an engagement structure (e.g., a slot) of printing chase 602 on one end 601(*a*) and a mating structure (e.g., a slot) of an object holder 603 on the other end 601(*b*). One or both ends of the registration structure 601 may include constraints for securely engaging the engagement structure of the print chase 602 and/or the mating structure of the object holder 603. For example, the registration structure 601 includes a retractable protrusion 610(*a*) and 610(*b*) at each end that prevents slippage and/or movement of the print chase 602 and/or the object holder 603 once engaged. In some embodiments, a retractable protrusion may increase the size (e.g., diameter) of an end of the registration structure such that the end cannot fit into a slot when the protrusion is not retracted. The retractable protrusion may be configured to be retracted (e.g., using a spring-loaded mechanism) when an end is being pushed through a slot, and may be released thereafter to hold the end in the slot. Other examples of constraints may include, without limitation, threads, bolts, or the like.

In some embodiments, the size of the registration structure may help to precisely and accurately locate, align, and/or orient the object holder in the z-direction (z-direction registration). Additionally and/or alternatively, the distance of the printing chase 602 from a plane AA' of the print heads may also be varied for accurate registration in the z-direction.

Figure 7:
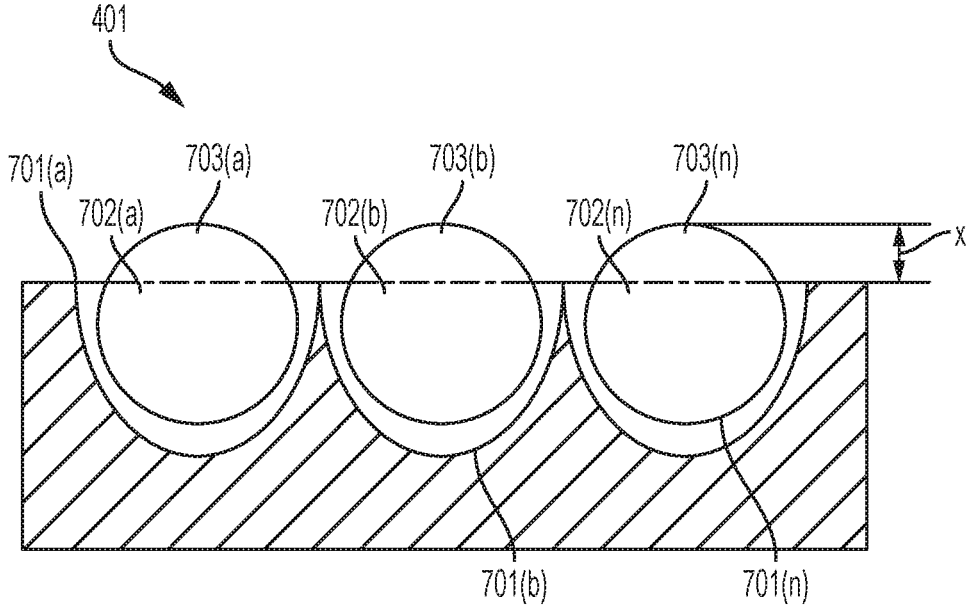
FIG. 7 depicts a front perspective view of an object holder, according to an embodiment.

Referring now to FIG. 7, an object holder 401 for holding one or more objects is illustrated. As shown in FIG. 7, the object holder 401 may include one or more holding portions 701(*a*), 701(*b*), and 701(*n*), where each holding portion is configured to securely hold an object 702(*a*), 702(*b*), and 702(*n*), respectively. For instance, the holding portions 701(*a*), 701(*b*), and 701(*n*) may form generally a silhouette of the shape of the object held within such that the object fits within its corresponding holding portion and movement is limited. Limited or restricted movement allows for accurate registration of each object with respect to the print heads during printing. To that end, it should be noted that the interior of the object holder 401 may include materials, such as rubber or foam, for absorbing shock to further prevent movement damage and/or internal structures such as side supporting walls. The object holder 401 may be formed using any suitable material such as cardboard, plastic, glass, rubber, foam, resins or the like.

In various embodiments, each holding portion is configured to hold an object such that at least a part of the object is not covered (or exposed) by a packing material and may form a "printable area" 703(*a*), 703(*b*), and 703(*n*). Alternatively and/or additionally, a printable area of an object may be covered by a removable packaging material (such as a transparent cover) that may be removed without damaging the object holder 401 before printing on the objects. In some embodiments, each object may include one or more printable areas. In some embodiments, the holding portions 701(*a*), 701(*b*), and 701(*n*) may be designed such that each of the printable areas 703(*a*), 703(*b*), and 703(*n*) have a depth "x" that is less than or equal to the maximum printing depth allowance for the print heads of the print system of FIG. 4. In various embodiments, the object holder 401 may also include one or more printable areas that may be exposed to the print heads of the print system of FIG. 4.

It will be understood to those skilled in the art that while FIG. 7 illustrates a 3-dimensional object holder for holding the objects within the holding portions, flat or 2-dimensional object holders with object mounted on the object holder (e.g., using adhesives, fastening devices, etc.) are within the scope of this disclosure.

In some embodiments, the object holder 401 may be a conventional packaging unit configured for packaging and shipping one or more objects held within, and adapted for mounting on a printer chase of the print system of FIG. 4 using one or more mating element (or mating structure). Examples of mating elements may include, without limitation, mating pins, mating grooves, mating holes, adhesive strips, screw, nuts and bolts, or the like. In some embodiments, one or more of the mating elements may be included in the object holder 401. Alternatively and/or additionally, one or more of the mating elements may be included in a structure associated with the object holder. For example, a mating element may be included in tabs, flaps, and/or or flanges molded (or attached by other suitable means) into a peripheral edge of the object holder 401. The mating elements may be removable (such as molded using perforated lines) or permanently molded.

In some embodiments, the mating elements may be configured to be complementary (in size, shape, position, and/or number, etc.) to the locking elements of a printing chase of a print system to be used for printing on the objects held by the object holder. In an alternate embodiment, the mating elements may be configured to be complementary (in size, shape, position, and/or number, etc.) to the alignment elements of a printing chase of a print system to be used for printing on the objects held by the object holder. In yet another embodiment, the mating elements may be configured to associate with (e.g., engage) a registration structure as shown in FIG. 5.

In various embodiments, the mating elements are positioned such that when engaged with a printing chase, each printable area of the objects held by the object holder and/or the object holder is properly aligned and oriented with respect to the print heads of a print system, and their position is accurately registered with respect to the print heads.

In some embodiments, an object holder 401, may also include an identification tag (not shown here) for providing identification and/or information regarding the object holder 401 to a controller of a print system. Examples of such identification systems may include, barcodes attached to or printed on the object holder, radio frequency identification (RFID) tags, QR codes, integrated chips, or the like.

Figure 8:
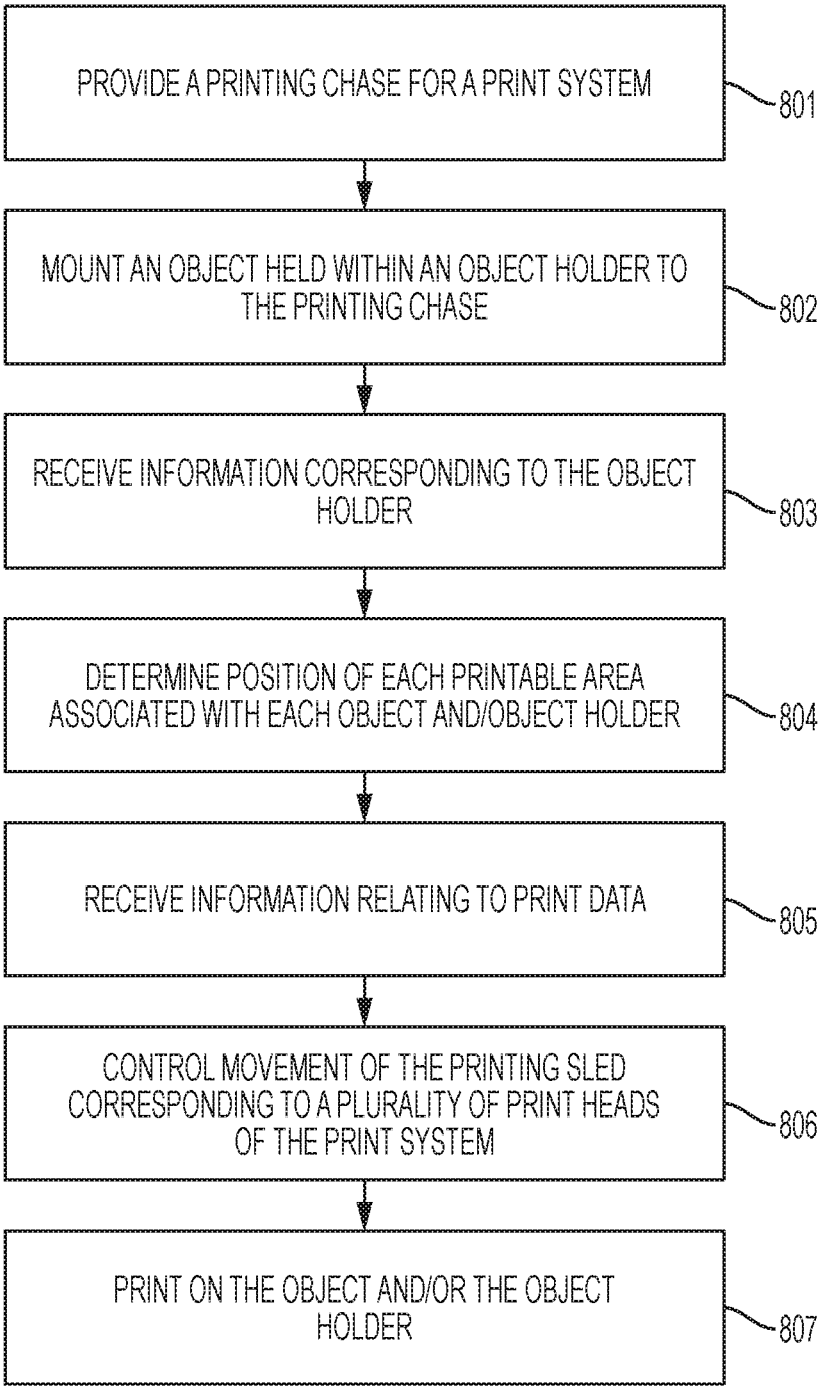
FIG. 8 depicts an example flowchart illustrating a method of a using an object holder for printing on an object, according to an embodiment.

Referring now to FIG. 8, an example flowchart describing a method for using an object holder for printing on one or more objects is illustrated.

In step 801, a printing chase that includes alignment elements and/or locking elements is provided for attachment to a support member and/or a moving sled of a print system. In step 802, an object held within an object holder may be mounted and aligned on the printing chase.

Next, the print system may receive (step 803) information corresponding to the object holder. In some embodiments, the system may receive the information (e.g., identifying information) by, for example, scanning a barcode or like attached to the object holder, from an RFID tag, using optical character recognition (OCR), scanning an image attached to the object holder, or the like. Examples of identifying information may include, without limitation, stock keeping unit number (SKU), a universal product code (UPC), an International Article Number (EAN), model numbers, product manufacturer name, product name, or the like. In some embodiments, the print system may then retrieve more information relating to the object holder and the objects held within using the identifying information. For example, the print system may access a database such as a product registration database and retrieve the above information using the identified information. Examples of information relating to the object holder and the objects held within may include, without limitation, type of objects held within the object holder, the number of objects included in object holder, information regarding the objects (such as shape, dimensions, material, etc.), information regarding the "printable area" of each object (such as shape, dimensions, material, etc.), information regarding a object holder (such as shape, dimensions, material, etc.), location of each object (and/or printable area) within a object holder, or the like.

Additionally and/or alternatively, the print system may receive information corresponding to the object holder based on the position and/or identity of alignment elements of the printing chase used to mount the object holder on the printing chase, as discussed above with respect to FIGS. 5A and 5B.

The print system may use the retrieved information to determine (step 804) the position of each printable area associated with each object held within the object holder mounted on the printing chase with respect to the print heads (i.e., register each printable area). In some embodiments, the print system may also use the retrieved information to determine position of each printable area associated with the object holder.

In step 805, the print system receive information relating to print data to be printed on each printable area of the objects and/or the object holder and may control the movement (step 806) using the registration information and the print data information.

In step 807, the print system may print on the objects as discussed above with respect to FIG. 1.

It should be noted that while the above disclosure describes embodiments that include a printing chase movable along the length dimension of an array of print heads, and the print heads are stationary, it will be understood to those skilled in the art that the print heads may also be movable to provide a relative motion between the print heads and the printing chase. Alternatively, the printing chase may be stationary and only the array of print heads may be movable.

Figure 9:
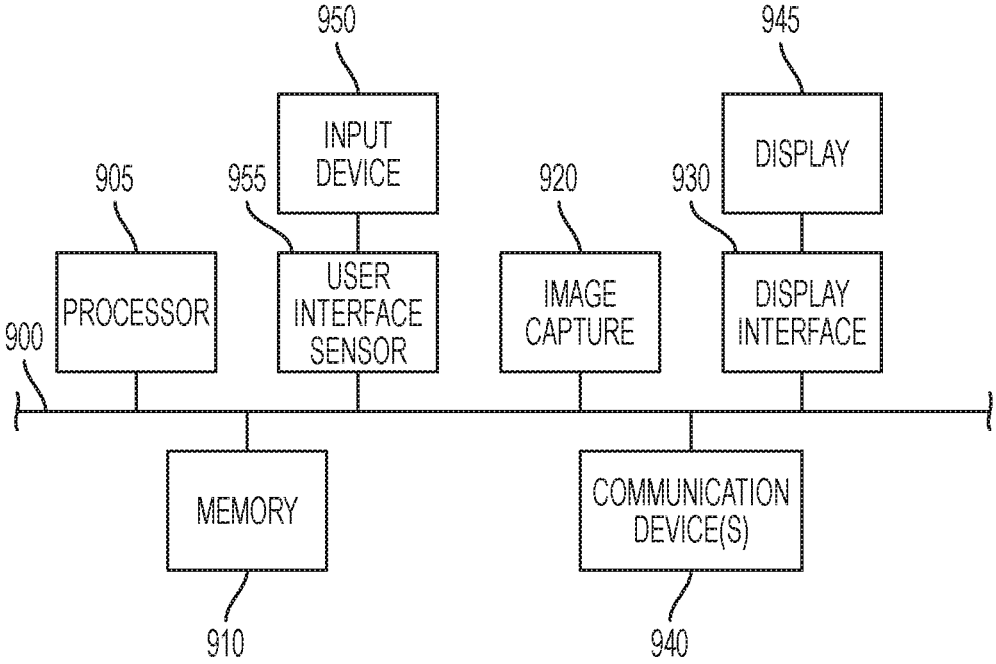
FIG. 9 depicts various embodiments of one or more electronic devices for implementing the various methods and processes described herein.

FIG. 9 depicts an example of internal hardware that may be included in any of the electronic components of the print system, such as the controller, or the print device. An electrical bus 900 serves as an information highway interconnecting the other illustrated components of the hardware. Processor 905 is a central processing device of the system, configured to perform calculations and logic operations required to execute programming instructions. As used in this document and in the claims, the terms "processor" and "processing device" may refer to a single processor or any number of processors in a set of processors. Read only memory (ROM), random access memory (RAM), flash memory, hard drives and other devices capable of storing electronic data constitute examples of memory devices 910. A memory device may include a single device or a collection of devices across which data and/or instructions are stored.

An optional display interface 930 may permit information from the bus 900 to be displayed on a display device 945 in visual, graphic or alphanumeric format. An audio interface and audio output (such as a speaker) also may be provided. Communication with external devices may occur using various communication devices 940 such as a transmitter, transceiver, antenna, communications port or a similar device. A communication device 940 may be attached to a communications network, such as the Internet, a local area network or a cellular telephone data network.

The hardware may also include a user interface sensor 955 that allows for receipt of data from input devices 950 such as a keyboard, a mouse, a joystick, a touchscreen, a remote control, a pointing device, a video input device and/or an audio input device. Data also may be received from an image capturing device 920, such of that a scanner or camera.

The above-disclosed elements and functions, as well as alternatives, may be combined into many other different systems or applications. Various presently unforeseen or unanticipated alternatives, modifications, variations or improvements may be made by those skilled in the art, each of which is also intended to be encompassed by the disclosed embodiments.

The invention claimed is:

1. A system for printing on a multi-dimensional object, the system comprising:
- a plurality of print heads;
- a printing chase configured to:
  - receive an object holder for an object, and
  - provide accurate registration of the object relative to the plurality of print heads;
- an actuator configured to move the printing chase relative to the plurality of print heads;
- a processing device; and
- a non-transitory, computer-readable memory containing programming instructions that are configured to cause the processing device to:
  - receive information corresponding to an object holder when the object holder is mounted on the printing chase,
  - determine, using the retrieved information, a position of one or more printable areas, wherein at least one of the one or more printable areas is located on the object holder,
  - receive information relating to print data to be printed on the one or more printable areas,
  - use the determined position of the one or more printable areas to control a movement of the printing chase relative to the plurality of print heads, via the actuator, and
  - operate the plurality of print heads to eject marking material onto the one or more printable areas such that the print data is printed on the one or more printable areas.

2. The system of claim 1, wherein:
- the printing chase comprises a plurality of alignment elements, wherein one or more of the plurality of alignment elements are associated with the object holder; and
- the instructions to receive information corresponding to the object holder comprise instructions to receive information corresponding to at least one alignment element included in the printing chase and employed for mounting the object holder on the printing chase.

3. The system of claim 2, wherein the information corresponding to the at least one alignment element included in the printing chase includes one or more of the following:
- position of the at least one alignment element or identity of the at least one alignment element.

4. The system of claim 1, wherein the instructions to receive information corresponding to the object holder comprise instructions to:
- receive identifying information corresponding to the object holder from an identification tag included in the object holder; and
- use the identifying information to determine information corresponding to the object holder.

5. The system of claim 4, wherein the information relating to the object holder comprises one or more of the following:
- a type of the object held within the object holder;
- a number of objects held within the object holder;
- information regarding one or more characteristics of the object held within the object holder;
- information regarding a printable area of the object held within the object holder;
- information regarding one or more characteristics of the object holder;
- information regarding a printable area of the object holder; or
- a location of the object within the object holder.

6. The system of claim 1, wherein at least a second one of the one or more printable areas is included in an object mounted on the object holder.

7. The system of claim 1, wherein the printing chase comprises:
- a base structure; and
- at least one alignment element configured to provide accurate registration of the object holder relative to the plurality of print heads.

8. The system of claim 7, wherein the printing chase further comprises a locking element configured to securely hold the object holder on the printing chase.

9. The system of claim 7, wherein the at least one alignment element comprises an engagement structure configured to engage a complementary registration structure.

10. The system of claim 9, wherein the engagement structure is associated with the object holder.

11. The system of claim 9, wherein the engagement structure is further configured to engage a mating element associated with an object holder.

12. The system of claim 9, wherein a size of the engagement structure is configured to provide accurate registration of the object holder relative to the plurality of print heads in a direction perpendicular to a plane of the print heads.

13. The system of claim 1, wherein the object holder comprises:

at least one mating element configured to mount the object holder on the printing chase; and at least one holding portion configured to hold a three-dimensional object.

14. The object holder of claim 13, further comprising an identification tag, wherein the identification tag comprises identification information relating to the object holder.

15. A method for printing on a multi-dimensional object, the method comprising:

by a processor, controlling a movement of a printing chase relative to a plurality of print heads, wherein a multi-dimensional object is held within an object holder mounted on the printing chase, by:

receiving information corresponding to an object holder mounted on the printing chase, determining, using the retrieved information, a position of one or more printable areas, wherein at least one of the one or more printable areas is located on the object holder, receiving information relating to print data to be printed on the one or more printable areas, using the determined position of the one or more printable areas to control the movement of the printing chase relative to the plurality of print heads, via an actuator, and operating the plurality of print heads to eject marking material onto on to the one or more printable areas such that the print data is printed on the one or more printable areas.

16. The method of claim 15, wherein:

the printing chase comprises a plurality of alignment elements, wherein one or more of the plurality of alignment elements are associated with the object holder; and receiving information corresponding to the object holder comprises receiving information corresponding to at least one alignment element included in the printing chase and employed for mounting the object holder on the printing chase.

17. The method of claim 16, wherein the information corresponding to the at least one alignment element included in the printing chase includes one or more of the following: position of the at least one alignment element or identity of the at least one alignment element.

18. The method of claim 15, wherein receiving information corresponding to the object holder comprises:

receiving identifying information corresponding to the object holder from an identification tag included in the object holder; and using the identifying information to determine information corresponding to the object holder.

19. The method of claim 15, wherein the information relating to the object holder comprises one or more of the following:

a type of the object held within the object holder;

a number of objects held within the object holder;

information regarding one or more characteristics of the object held within the object holder;

information regarding a printable area of the object held within the object holder;

information regarding one or more characteristics of the object holder;

information regarding a printable area of the object holder; or a location of the object within the object holder.

20. The method of claim 15, at least a second one of the one or more printable areas is included in an object mounted on the object holder.

* * * * *